United States Patent [19]

Economopoulos et al.

[11] 4,203,783

[45] May 20, 1980

[54] PROCESS FOR IMPROVING THE QUALITY OF STEEL SECTIONS

[75] Inventors: Marios Economopoulos, Liege; Yves J. Respen, Herstal, both of Belgium

[73] Assignee: Centre De Recherches Metallurgiques, Brussels, Belgium

[21] Appl. No.: 943,392

[22] Filed: Sep. 18, 1978

[30] Foreign Application Priority Data

Sep. 19, 1977 [BE] Belgium ..... 858862

[51] Int. Cl.[2] ..... C21D 7/14

[52] U.S. Cl. ..... 148/12.4; 148/39; 148/145; 148/146; 148/152; 148/153

[58] Field of Search ..... 148/143, 12.4, 145, 148/146, 152, 153, 39

[56] References Cited

U.S. PATENT DOCUMENTS 4,016,015 4/1977 Respen et al. ..... 148/12.4

*Primary Examiner*—R. Dean

*Attorney, Agent, or Firm*—Holman & Stern

[57] ABSTRACT

The elastic limit and breaking load of steel sections are improved by a process of surface quenching and self-tempering comprising a cooling stage followed by rapid cooling which is interrupted to allow the quenched surface layer of the section to be tempered by heat from non-quenched inner portions of the section. The rapid cooling is succeeded by a slow cooling.

2 Claims, 5 Drawing Figures

PROCESS FOR IMPROVING THE QUALITY OF STEEL SECTIONS

Figure 1:
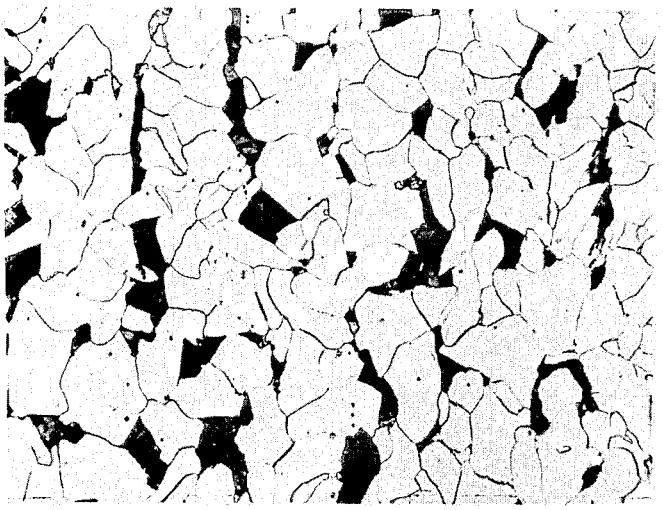

The present invention relates to a process for improving the quality of steel sections. In the present invention, the term "sections" is taken to mean girders, U-shaped sections, angle-irons, T-shaped sections, flat bars, wide flat bars, billets and sheet metal, and in a general sense all rolled metal having at least one flat surface.

It is common knowledge that the main qualities required by the users of steel sections are, inter alia, a breaking load, an elastic limit and a resilience which are as high as possible for the composition of the steel used, as well as a weldability, fatigue resistance and ductility sufficient for the use to which the section is intended to be put.

The applicants have already suggested an economical cooling treatment which prevents, in the sections in question, the carbon and manganese contents of the steel from increasing unacceptably in their detrimental influence on weldability and resilience at low temperature.

This treatment is characterised in that, directly on leaving the finishing roll stand, the flat face (flange or tread for example) of the section (the web of U-shaped sections being regarded as a flange in this connection) is subjected to a surface quenching by means of a suitable cooling liquid; the quenching treatment is interrupted by regulating the cooling conditions so that, when the section leaves the quenching area, in the first place only the outer layer of the flat face is transformed into bainite and/or martensite, in the second place the non-quenched parts of the sections are still at a sufficiently high temperature to permit a tempering of the quenched outer layer by the heat in the non-quenched part, and in the third place the austenite may be transformed into ferrite and carbides in the non-quenched parts of the sections.

The steel section to which the treatment described above is subjected is characterised in that in a cross-section perpendicular to its axis its structure comprises at least two zones substantially parallel to the surface of the flat element constituting the section, one of these zones being formed essentially by tempered bainite and/or martensite, and the other being formed mainly by non-tempered ferrite-perlite.

This process gives excellent results and the section made in this way noteworthy mechanical properties. Since these properties may be greater than what is required of the product and, in order to attain them, the working of the process may sometimes present problems difficult to solve and/or may be more expensive and of no use under the circumstances, the applicants have sought to perfect a process which will overcome these drawbacks.

The process for treating the sections, which forms the subject matter of the present invention, in which, when the section leaves the rolling mill, the outer layer of the flat face (flange or tread for example) of the sections (the web of the U-shaped sections being regarded as a flange in this connection) is subjected to a treatment of surface quenching and self-tempering, is essentially characterised in that the said treatment is carried out in three stages, in which the first consists of a cooling such that the structure of the outer layer comprises a mixture of austenite and ferrite, the second stage consists of a rapid cooling by means of a suitable cooling liquid so that the structure of the outer layer comprises a mixture of ferrite and martensite and/or bainite, this second stage being interrupted so that the non-quenched parts of the sections comprising residual austenite are at a sufficiently high temperature to permit a tempering of the quenched outer layer by the heat in the non-quenched parts, and the third stage consists of a slow cooling so that the austenite in the said non-quenched parts of the section may be transformed into ferrite and carbides.

According to the invention, the first stage is advantageously carried out during the transfer of the section to a plant connected to the installation situated at the exit of the finishing stand of the rolling mill.

The values indicated below are given by way of non-limiting example. They are figures relating to flat bars 20 mm in thickness.

The composition by weight of the steel from which these flat bars are formed is as follows: C=0.15%, Mn=0.83%, Si=0.26%, balance Fe and unavoidable impurities.

The mechanical properties of these three flat bars are as follows:

| Flat bar No. 1: | |
|---|---|
| As-rolled state (without surface hardening and self-tempering according to the invention) | |
| elastic limit ($R_e$) | 276 N/mm$^2$ |
| breaking load ($R_r$) | 425 N/mm$^2$ |
| elongation (A) | 36.4 % |
| contraction of cross-section (S) | 68.1 % |

| Flat bar No. 2 treated according to the invention: | |
|---|---|
| temperature at the end of rolling | 850° C. |
| temperature at the beginning of quenching ($T_o$) | 775° C. |
| tempering temperature | 500° C. |
| elastic limit ($R_e$) | 450 N/mm$^2$ |
| breaking load ($R_r$) | 565 N/mm$^2$ |
| elongation (A) | 36.4 % |
| reduction in area (S) | 68.1 % |
| resilience at −20° C. | 160 J/cm$^2$ |
| resilience at −60°C. | 65 J/cm$^2$ |

| Flat bar No. 3 treated according to the invention: | |
|---|---|
| temperature at the end of rolling | 850° C. |
| temperature at the beginning of quenching ($T_o$) | 750° C. |
| tempering temperature | 580° C. |
| elastic limit ($R_e$) | 382 N/mm$^2$ |
| breaking load ($R_r$) | 516 N/mm$^2$ |
| elongation (A) | 28 % |
| reduction in area (S) | 65.7 % |
| resilience at −20° C. | 140 J/cm$^2$ |
| resilience at −60° C. | 40 J/cm$^2$ |

It may be seen that the relative results in the case of flat bars Nos. 2 and 3 represent a quite substantial improvement with respect to the relative values in the case of flat bar No. 1.

In addition, flat bar No. 2, which has been treated at a tempering temperature (500° C.) lower than that of flat bar No. 3 (580° C.), has properties superior to that of the latter. This feature likewise occurs in working the process which forms the subject matter of the present invention: the tempering temperature is reduced and the mechanical properties are at the same time more satisfactory.

Photomicrographs (magnified 500 times) are attached which show the structure of the above three flat bars, in which FIG. 1 is the structure of flat bar No. 1.

Figure 2A:
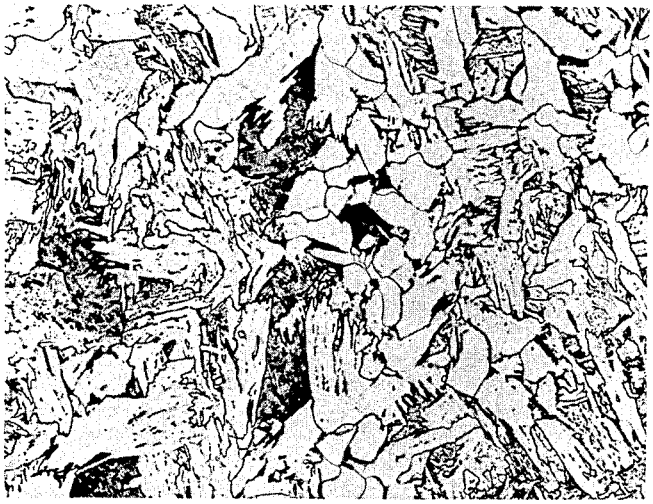

FIG. 2*a* is the core structure of flat bar No. 2

Figure 2B:
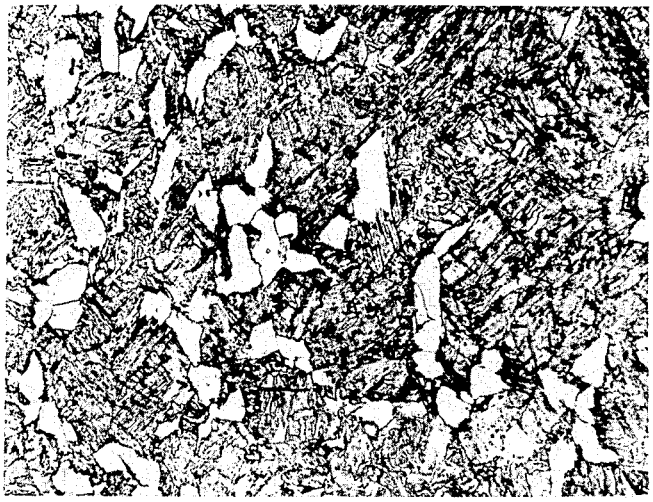

FIG. 2*b* is the surface structure (0.8 mm from the edge) of flat bar No. 2

Figure 3A:
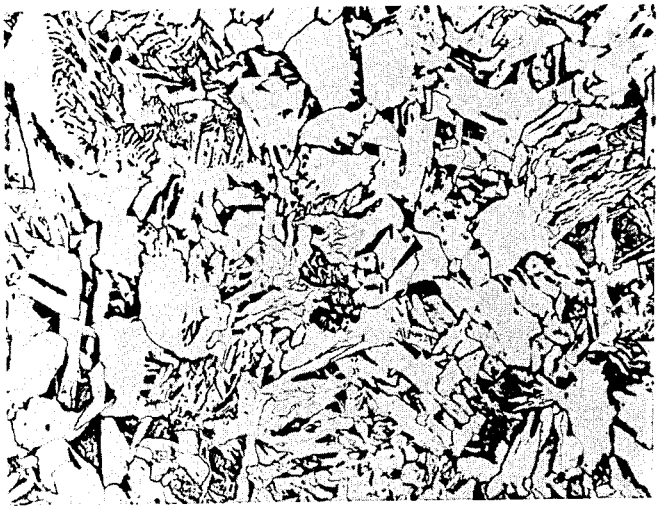

FIG. 3*a* is the core structure of flat bar No. 3

Figure 3B:
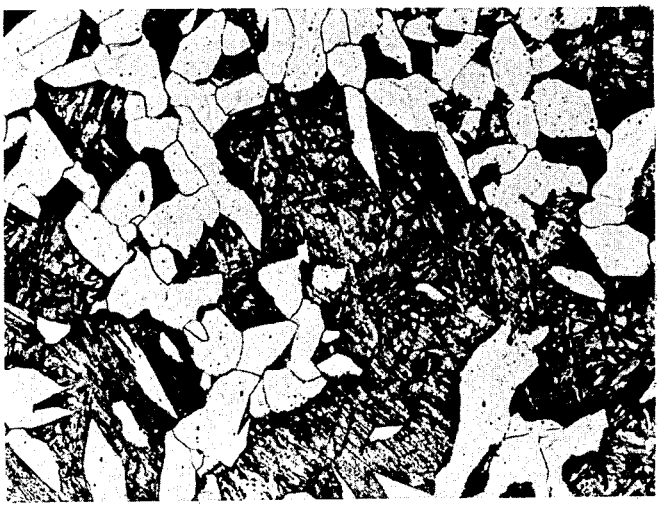

FIG. 3*b* is the surface structure (1 mm from the edge) of flat bar No. 3.

The process described above is thus beneficial in permitting the advantages of rapid cooling with self-tempering to be made use of, in plants where it would not normally be possible to carry out such a treatment because of technical difficulties and/or excessive cost.

We claim:

1. A process for improving the quality of steel sections, in which, when the section leaves the rolling mill, the outer layer of a flat face of the section is subjected to a treatment of surface quenching and self-tempering, characterised in that the said treatment is carried out in three stages, in which the first stage consists of cooling such that the structure of the outer layer comprises a mixture of austenite and ferrite, the second stage consists of rapid cooling by means of a suitable cooling liquid so that the structure of the outer layer comprises a mixture of ferrite and martensite and/or bainite, this second stage being interrupted so that the non-quenched parts of the sections comprising residual austenite are at a sufficiently high temperature to permit a tempering of the quenched outer layer by the heat in the non-quenched parts, and the third stage consists of slow cooling so that the austenite in the said non-quenched parts of the section transforms into ferrite and carbides.

2. A process according to claim 1, characterised in that the said first stage is carried out during the transfer of the section to a plant connected to the installation situated at the exit of the finishing stand of the rolling mill.

* * * * *